US008387342B2

(12) United States Patent
Rutschmann

(10) Patent No.: US 8,387,342 B2
(45) Date of Patent: Mar. 5, 2013

(54) PICKING LINE AND METHOD FOR INSERTING PRODUCTS INTO A PACKAGING CONTAINER

(75) Inventor: Harry Rutschmann, Klettgau-Griessen (DE)

(73) Assignee: Robert Bosch GmbH, Stuttgart (DE)

( * ) Notice: Subject to any disclaimer, the term of this patent is extended or adjusted under 35 U.S.C. 154(b) by 477 days.

(21) Appl. No.: 12/738,424

(22) PCT Filed: Sep. 19, 2008

(86) PCT No.: PCT/EP2008/062561

§ 371 (c)(1),
(2), (4) Date: Apr. 16, 2010

(87) PCT Pub. No.: WO2009/049990

PCT Pub. Date: Apr. 23, 2009

(65) Prior Publication Data

US 2010/0223883 A1 Sep. 9, 2010

(30) Foreign Application Priority Data

Oct. 17, 2007 (DE) ..... 10 2007 049 702

(51) Int. Cl.
*B65B 57/00* (2006.01)
*B65B 31/30* (2006.01)

(52) U.S. Cl. ..... 53/54; 53/500

(58) Field of Classification Search ..... 53/443, 53/53, 54, 493, 500
See application file for complete search history.

(56) References Cited

U.S. PATENT DOCUMENTS

| | | | |
|---|---|---|---|
| 5,040,056 | A | 8/1991 | Sager et al. |
| 6,122,895 | A | 9/2000 | Schubert |
| 7,240,465 | B2 | 7/2007 | Davi et al. |

FOREIGN PATENT DOCUMENTS

| | | | |
|---|---|---|---|
| EP | 0706838 | A1 | 4/1996 |
| GB | 2356699 | A | 5/2001 |
| WO | 2004018332 | A1 | 3/2004 |

*Primary Examiner* — M. Alexandra Elve
*Assistant Examiner* — John Paradiso
(74) *Attorney, Agent, or Firm* — Michael Best & Friedrich LLP

(57) ABSTRACT

The invention relates to a picking line for inserting products into a packaging container, having a conveyor belt for the delivery and the transport of products in a transport direction, and at least one picker equipped with a position image processing system for determining the position of the products on the conveyor belt. A quality image processing system is disposed in the transport direction upstream of the at least one picker for checking the products passing the quality image processing system on the conveyor belt in the transport direction for predetermined quality features, and for associating quality information to be transmitted to a picker adjacent downstream of the quality image processing system in the transport direction, serving as a control command for grasping or not grasping the products.

7 Claims, 2 Drawing Sheets

PICKING LINE AND METHOD FOR INSERTING PRODUCTS INTO A PACKAGING CONTAINER

CROSS-REFERENCE TO RELATED APPLICATION

This application is a 35 USC 371 application of PCT/EP2008/062561 filed on Sep. 19, 2008.

BACKGROUND OF THE INVENTION

1. Field of the Invention

The invention relates to a picking line for inserting products into a packaging container, having a conveyor belt for supplying and transporting products in a transport direction and having at least one picker equipped with a position image processing system for determining the position of the products on the conveyor belt. The scope of the invention also includes a method for operating the picking line.

2. Description of the Prior Art

Picker lines equipped with an image processing system for detecting the positions of products in random orientations on a moving conveyor belt are known, for example, from U.S. Pat. No. 5,040,056 and U.S. Pat. No. 6,122,895.

There are also known image processing systems for inspecting predetermined quality features such as the color and shape of a product.

In picking lines for packaging products using the pick and place system, the quality testing of the products to be packaged, e.g. biscuits and similar small baked goods, is usually carried out by visually inspecting the products being supplied on a conveyor belt. Products that do not conform to the quality requirements are rejected manually.

It is also conceivable to basically use known image processing systems to inspect the quality of the products supplied on a conveyor belt before they are packaged in a picking line and to automatically reject products that do not conform to the required quality standard, e.g. by means of the method described in WO 2004/018332.

OBJECT AND SUMMARY OF THE INVENTION

The object of the invention is to modify a picking line of the type described at the beginning so that only products that conform to predetermined quality requirements are picked.

Another object of the invention is the detection of quality data in a central system.

Another object of the invention is a displaying of the quality defects of the products that are not picked.

The object of the invention is attained by the fact that a quality image processing system is situated upstream of the at least one picker in the transport direction and is used for inspecting the products, which are passing by the quality image processing system on the conveyor belt in the transport direction, with regard to predetermined quality features and for associating a piece of quality information that serves as a control command for grasping or not grasping the products and is to be transmitted to a subsequent picker downstream of the quality image processing system in the transport direction.

In order to also comply with even extremely high safety requirements, it is also possible to install two systems in a redundant fashion.

Preferably, at least two pickers, each equipped with a position image processing system, are situated one after the other in the transport direction; each picker is provided to transmit the piece of quality information serving as a control command for grasping or not grasping the products and the position data for the products not grasped by this picker to the subsequent picker.

Each picker sends the received quality information and the position data detected by its position image processing system to the next respective picker and the quality data determined by the quality image processing system flows to all of the pickers. In the event of a failure of its own position image processing system, each picker adopts the position data detected by the preceding picker, i.e. the system is set up in redundant fashion.

In the event of a failure of an image processing system or a picker, the quality information serving as a control command for grasping or not grasping the products and the position data for the products not grasped by this picker can be transmitted to the next picker.

In the event of a failure of one picker, the picker preceding the failed picker transmits the quality information serving as a control command for grasping or not grasping the products and the position data for the products not grasped by this picker to the next picker downstream of the failed picker. In the event of a total failure of one picker, this picker is thus bypassed, i.e. the quality information and the position data go from the preceding picker directly to the subsequent picker.

Preferably, the shape and color of the products and the presence of graphic features on the products are evaluated as quality criteria.

In a preferred method for operating the apparatus according to the invention, the products are depicted on a screen and the quality features that the quality image processing system detects for the products are displayed. The products detected by the position image processing system are advantageously highlighted separately.

The pick and place system according to the invention assures that only products that conform to predetermined quality requirements are picked. The features are detected by a quality image processing system and the products are classified according to their shape, color, structure, or the presence of particular properties such as mixed spices and the like. This information is communicated to the individual pickers in the picking line. Each picker has a separate position image processing system because the products can shift in the course of time. The quality information detected by the quality image processing system is associated with products that are detected with more exact coordinates in the position image processing system. Products not picked must be passed on to the subsequent picker with the general quality information "good" or "bad"; the lack of only one of the pieces of quality information results in the "bad" qualification that is decisive for the control of the picker. Bad products, i.e. ones that do not conform to the quality requirements in at least one point, are not picked by any picker and exit the system at its end. In order to pinpoint the causes underlying the quality defects, all pieces of quality information associated with a product are transmitted to the monitoring system explained below.

In order to monitor the picking line, a user interface, usually a screen, is suitably provided on which good and bad products and the error type are depicted, making it possible to distinguish whether products have not been picked due to a quality defect or whether there are other reasons that a product has not been packaged, for example when the system is overloaded or incorrectly adjusted. It should also be possible to detect whether the pickers were able to associate the quality information with the products or whether the position tolerance between the quality image processing system and the position image processing system was too great. The indication of the error type makes it possible to directly deduce the occurrence of problems in the manufacturing process of the products (e.g. incorrect baking temperature, problems applying a spice mixture, etc.) so that these situations can be rectified. The system should also make it possible to continue operation of the line even if individual pickers and image processing systems fail.

The proposed system with the apparatus according to the invention includes, among other things, the following advantages:

The quality image processing system is independent of the position image processing system. In this context, the pinpointing by means of position image processing systems is standard for all types of products, while the quality image processing system is adapted specifically to each respective project.

There is only one quality image processing system, which permits simple operation and achieves cost savings.

The reason for products not being picked is immediately evident, e.g. insufficient quality of the products as well as the quality problem that is actually present, so that corrections can be carried out in the process systems or problems in the association of the products in the position image processing system due to excessive tolerance between the quality and position image processing systems, picker overload, etc.

Since good and bad products are displayed differently, intuitive learning about the system behavior occurs. For example, multitrack lines feature very rapid detection of which track, perpendicular to the belt travel direction, most of the problems are occurring in. This makes it possible to pinpoint the location of a possible process optimization.

High error tolerance in the event of a failure of individual pickers or vision systems.

BRIEF DESCRIPTION OF THE DRAWINGS

Other advantages, features, and details of the invention ensue from the following description of preferred embodiments in conjunction with the drawings, in which.

DESCRIPTION OF THE PREFERRED EMBODIMENTS

Figure 1:
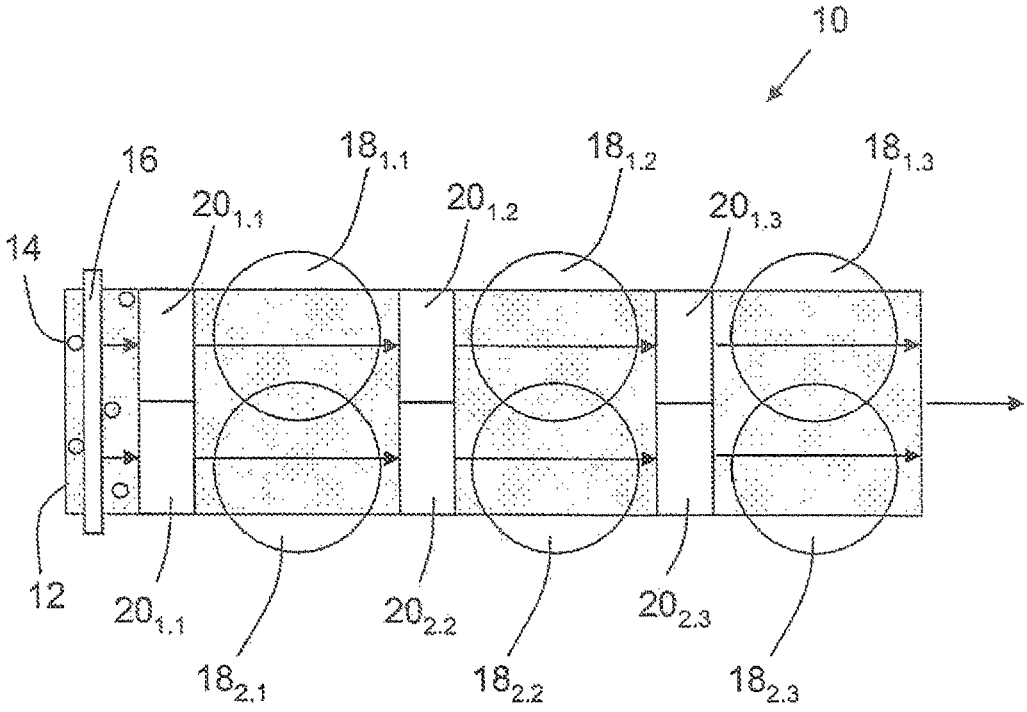
FIG. 1 is a schematic top view of a picking line.

A picking line 10 shown in FIG. 1 has a revolving conveyor belt 12 for transporting products 14 to be packaged in a transport direction x. Along the conveyor belt 12 in the transport direction x, three pickers $\mathbf{18}_{1.1}$, $\mathbf{18}_{1.2}$, $\mathbf{18}_{1.3}$, and $\mathbf{18}_{2.1}$, $\mathbf{18}_{2.2}$, $\mathbf{18}_{2.3}$, respectively, characterized by their working range, are arranged one behind another in two parallel lines so that the working ranges respectively overlap and thus cover the entire width of the conveyor belt 12. Upstream of each picker $\mathbf{18}_{1.1}$, $\mathbf{18}_{1.2}$, $\mathbf{18}_{1.3}$, and $\mathbf{18}_{2.1}$, $\mathbf{18}_{2.2}$, $\mathbf{18}_{2.3}$, respectively, in the transport direction x, a respective position image processing system $\mathbf{20}_{1.1}$, $\mathbf{20}_{1.2}$, $\mathbf{20}_{1.3}$, and $\mathbf{20}_{2.1}$, $\mathbf{20}_{2.2}$, $\mathbf{20}_{2.3}$, respectively, assigned to each picker extends transverse to the transport direction x across the region of the conveyor belt 12 covered by the associated picker so that respective pairs of position image processing systems cover the entire width of the conveyor belt. At the beginning of the conveyor belt 12, a quality image processing system 16 extends transversely across the entire width of the conveyor belt 12. Errors and product features that can be detected by the quality image processing system 16 include, for example, shape, damage, color, logos, etc.

In the exemplary embodiment shown, the picking line 10 has only two parallel rows with three pickers 18 each. It is also possible for less or more than three pickers 18 to be arranged in only one row or in more than two rows. In general, a picking line 10 is composed of a plurality of pickers 18 situated one behind another, which are arranged in one or more parallel rows. The quality image processing system 16 sends all of the product data to the first picker 18. In systems with several parallel rows of pickers 18, each first picker 18 is sent the portion of product data corresponding to its working range, including an overlap region.

Figure 2:
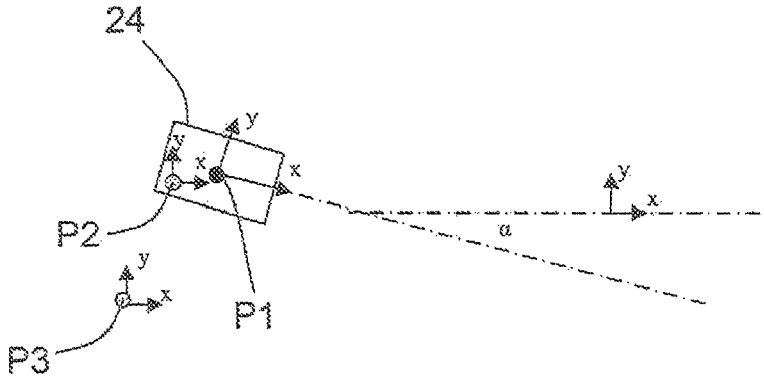
FIG. 2 schematically depicts the detection of a product, which is being classified by a quality image processing system, by means of a position image processing system associated with one picker.

The product 14 to be packaged—e.g. small baked goods that are transported from an oven to the picking line 10 and are ready for packaging—are dispersed randomly over the entire width of the conveyor belt 12 upstream of the quality image processing system 16 in the transport direction x and are supplied to the picking line 10. When the products 14 pass under the quality image processing system 16, in addition to the position of each product 14 on the conveyor belt 12, predetermined quality features such as shape, color, and the like, which are detectable on the finished product 14 and are suitable for determining the product quality, are recorded and sent to the first pickers 18 situated downstream of the quality image processing system 16 in the transport direction x. When the products 14 pass under the position image processing system 20 of the first pickers 18, the exact coordinates of the products 14 on the conveyor belt 12 are detected and compared to the data recorded in the quality image processing system 16; because of the less precise position determination by the quality image processing system 16, the association of the data coming from this system is carried out by means of the position image processing system 20 using a tolerance window 24 (FIG. 2). The position image processing system 20 transmits the data of the products 14 thus detected to the associated picker 18 that packages a portion of the good products 14. The data of the products 14 that the position image processing system 20 detects are likewise transmitted to the position image processing system 20 of the subsequent picker 18. This procedure is repeated for each additional subsequent picker 18 situated downstream in the transport direction x. Each picker 18 can, as needed, also access the position data of the preceding picker 18. In a picking line 10 equipped with a sufficient number of pickers 18 in accordance with the packaging output, only the products 14, which have been recorded as "bad" by the quality image processing system 16 due to a quality defect and have therefore not been packaged, remain as rejects at the end of the conveyor belt 12 after the last picker 18.

As shown in FIG. 2, the association of a product 14 detected by the quality image processing system 16 with a product detected by the position image processing system 20 of a picker 18 is carried out using a tolerance window 24 because of the less precise position determination by means of the quality image processing system 16 in comparison to the position image processing system 20 of the picker 18. The following labels are used for the various positions of a product 14:

P1: local position detected by the position image processing system 20 of the picker 18

P2: position detected by the quality image processing system 16, situated inside the tolerance window 24

P3: position detected by the quality image processing system 16, situated outside the tolerance window 24 x, y: position coordinates for P1 corresponding to the position of the tolerance window, for P2 and P3 corresponding to the orientation of the conveyor belt 12

Only a product 14 whose position P2 detected by the quality image processing system 16 is situated inside the tolerance window 24 is picked by the picker 18, provided that the quality requirements for this product have been met. The product 14 whose position P3 is situated outside the tolerance window 24 will not be picked regardless of the quality.

Figure 3:
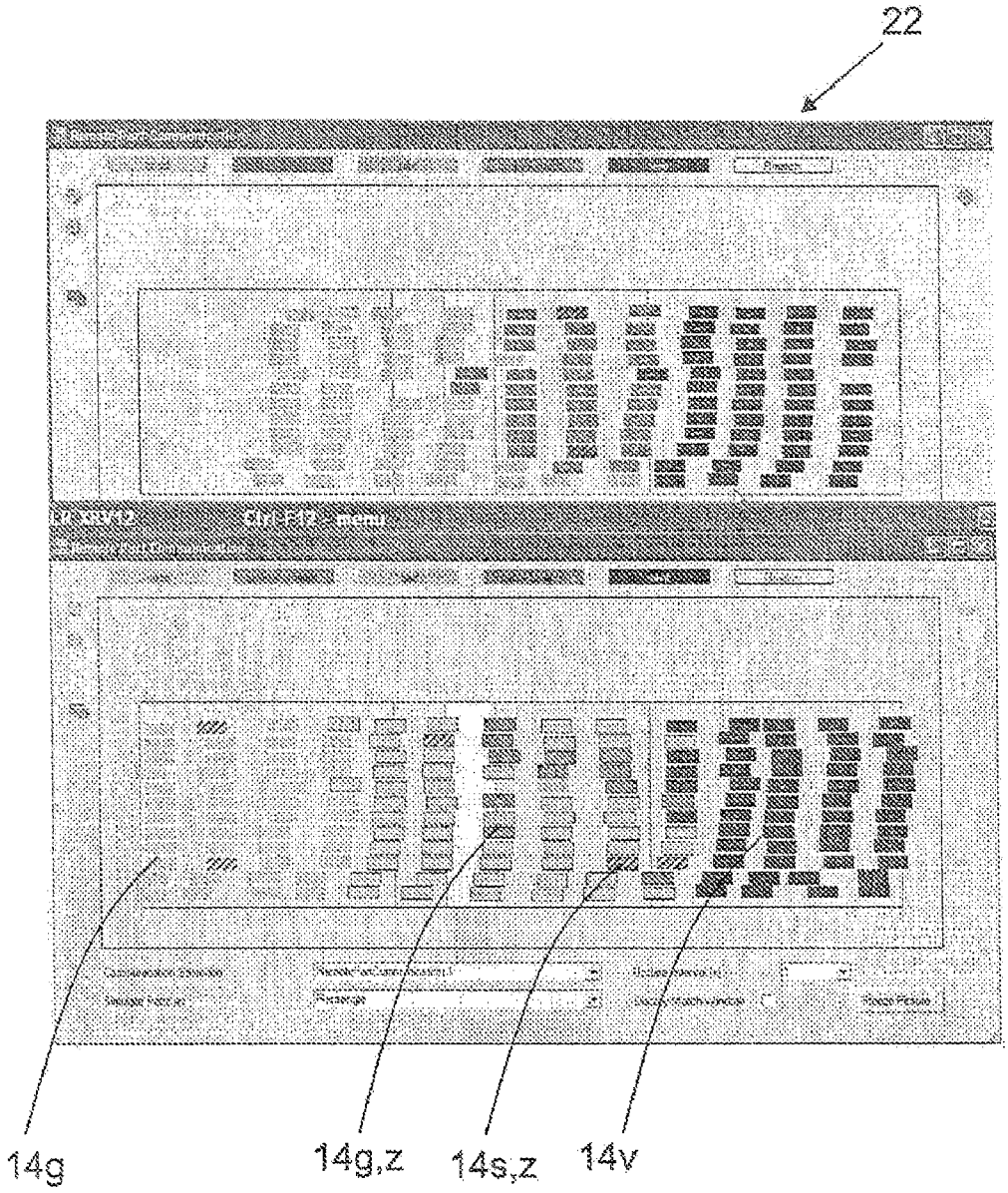
FIG. 3 schematically depicts products shown on a screen, with displayed quality features.

FIG. 3 shows the products 14, which have been detected and classified by the quality image processing system 16 and are moving past in the transport direction x on the conveyor belt 12, with their position on the conveyor belt represented in the form of rectangles, labeled as "good" (14*g*) by means of a light color or as "bad" (14*s*) by means of a crosshatching corresponding to the error type. Products (z) that have been associated by the position image processing system 20 are depicted in a darker hue.

The current state of the layer of products on the conveyor belt 12 can be seen at any time on the screen 22. In particular the reason for which products 14 exit the system without being packaged is also displayed, e.g. due to a detected quality defect, an excessive position tolerance (data of the quality image processing system 16 and position image processing system 20 could not be brought into agreement), or due to an overloading of the system.

If a position image processing system 16 fails, this is detected and the image processing data of the preceding picker 18 are sent to the pickers 18 affected by the failure so that production can continue uninterrupted. It is also possible to detect the failure of a picker control unit so that the data are communicated to the next usable picker, bypassing the failed picker. Only the failure of the quality image processing system 16 causes the line to be shut down.

The position deviation between communicated and locally detected data is depicted on the screen 22 in the form of a dash situated off-center in relation to the locally detected product. If only a dot is visible there, then the data are stable. This function helps in the adjustment of the offset among a plurality of camera systems. It is also possible to diagnose the wearing-out of the belt, encoder synchronization problems, and similar undesirable effects.

For each locally detected part (=a part that has been detected by the quality image processing system and by the position image processing system of the picker) with the position P1, the screen 22 indicates whether there is an appropriate remote part (=a part that has been detected by the quality image processing system, but was not detected by the position image processing system) with a position P2 situated inside the tolerance window 24. In this connection, it is necessary to differentiate among the following states:

For a locally detected part, there is an appropriate remote part: the locally detected part can be associated with a piece of quality information. If the quality conforms to the requirements, then the product is communicated to the picker queue.

For a locally detected part, there is no appropriate remote part: the product is not communicated to the picker queue.

There is a remote part, but no corresponding part is locally detected: the part has probably been packaged by a preceding picker. No data are transmitted to the picker queue.

Each system transmits its product data to the subsequent system as soon as the corresponding product has traveled out of the working range of the picker. Correctly transmitted product data 14*v* are highlighted in a separate color.

In the example shown, the display system is implemented on the local picker control units and in this instance, depicts a respective section of each picker's own working range as well as the working ranges of the adjacent pickers. The system can, however, also be implemented system-wide, displaying the state of the entire system.

The foregoing relates to the preferred exemplary embodiments of the invention, it being understood that other variants and embodiments thereof are possible within the spirit and scope of the invention, the latter being defined by the appended claims.

The invention claimed is:

1. A method for inserting products into a packaging container by means of a picking line having a conveyor belt for supplying and transporting products in a transport direction and having at least one picker associated with the conveyor belt, equipped with a position image processing system for determining the position of the products on the conveyor belt, the method comprising the steps of:

inspecting the products with a quality image processing system situated upstream of the at least one picker in the transport direction with regard to predetermined quality features, while passing the products by the quality image processing system on the conveyor belt in the transport direction, and associating a piece of quality information that serves as a control command for grasping or not grasping the products, to a picker downstream of the quality image processing system in the transport direction, wherein at least a first picker and a subsequent picker, each equipped with a position image processing system, are disposed one after the other in the transport direction, wherein the quality information serving as a control command for grasping or not grasping the products and the position data for the products not grasped by the first picker is transmitted to the subsequent picker, and (a) in an event of a failure of an image processing system or a picker, the quality information serving as a control command for grasping or not grasping the products and the position data for the products not grasped by this picker is transmitted to the picker, or (b) in an event of a failure of one of the pickers, the picker preceding a failed picker transmits the quality information serving as a control command for grasping or not grasping the products and the position data for the products not grasped by the failed picker to a picker subsequent to the failed picker.

2. The method as recited in claim 1, wherein shape and color of the products and presence of graphic features on the products are evaluated as quality criteria.

3. The method as recited in claim 2, wherein the products are depicted on a screen and the quality features detected by the quality image processing system for the products are displayed.

4. The method as recited in claim 3, wherein the products detected by the position image processing system are highlighted separately on the screen.

5. The method as recited in claim 1, wherein the products are depicted on a screen and the quality features detected by the quality image processing system for the products are displayed.

6. The method as recited in claim 5, wherein the products detected by the position image processing system are highlighted separately on the screen.

7. A picking line for inserting products into a packaging container, having:

a conveyor belt for supplying and transporting products in a transport direction;

at least one picker equipped with a position image processing system for determining the position of the products on the conveyor belt; and a quality image processing system disposed upstream of the at least one picker in the transport direction which inspects the products, which pass by the quality image processing system on the conveyor belt in the transport direction, with regard to predetermined quality features, and which associates a piece of quality information that serves as a control command for grasping or not grasping the products, to a subsequent picker downstream of the quality image processing system in the transport direction, wherein at least a first picker and a subsequent picker, each equipped with a position image processing system, are disposed one after the other in the transport direction, wherein the quality information serving as a control command for grasping or not grasping the products and the position data for the products not grasped by the first picker is transmitted to the subsequent picker, and (a) in an event of a failure of an image processing system or a picker, the quality information serving as a control command for grasping or not grasping the products and the position data for the products not grasped by this picker is transmitted to the picker, or (b) in an event of a failure of one of the pickers, the picker preceding a failed picker transmits the quality information serving as a control command for grasping or not grasping the products and the position data for the products not grasped by the failed picker to a picker subsequent to the failed picker.

* * * * *